US005955715A

United States Patent [19]

Perret

[11] Patent Number: 5,955,715

[45] Date of Patent: Sep. 21, 1999

[54] CIRCUIT BREAKER HAVING A CLOSURE RESISTANCE

[75] Inventor: Michel Perret, Bourgoin-Jallieu, France

[73] Assignee: GEC Alsthom T & D SA, Paris, France

[21] Appl. No.: 09/095,713

[22] Filed: Jun. 11, 1998

[30] Foreign Application Priority Data

Jun. 12, 1997 [FR] France ..... 97 07284

[51] Int. Cl.[6] ..... H01H 33/18; H01H 33/70; H01H 33/82

[52] U.S. Cl. ..... 218/43; 218/154; 218/156

[58] Field of Search ..... 218/7, 11, 14, 218/16, 17, 18, 19, 43, 48, 49, 50, 53, 54, 57, 59, 60, 61, 62, 63, 64, 65, 72, 73, 78, 154, 156

[56] References Cited

U.S. PATENT DOCUMENTS 4,774,388 9/1988 Thuries et al. ..... 218/154
4,945,198 7/1990 Thuries et al. ..... 218/154

FOREIGN PATENT DOCUMENTS

3411445A1 8/1985 Germany .

*Primary Examiner*—Lincoln Donovan
*Attorney, Agent, or Firm*—Sughrue, Mion, Zinn, Macpeak & Seas, PLLC

[57] ABSTRACT

A circuit breaker which includes first arcing and permanent contacts that are mounted stationary inside an enclosure, second arcing and permanent contacts that are mounted to move inside the enclosure along a longitudinal direction and designed to co-operate with the first contacts, and a system for inserting a closure resistance, the second contacts forming a portion of equipment carrying a blast nozzle. The resistance insertion system comprises a semi-moving block which is disposed to be displaced in the longitudinal direction by the blast nozzle during a closure operation. The block carries a first switching contact designed to co-operate with a stationary second switching contact connected to the first stationary permanent contact. By displacement of the block, the first and second switching contacts are moved towards each other to short circuit the closure resistance while the first and second arcing contacts are in contact with each other and the first and second permanent contacts are separate from each other.

5 Claims, 6 Drawing Sheets

CIRCUIT BREAKER HAVING A CLOSURE RESISTANCE

FIELD OF THE INVENTION

The invention relates to a circuit breaker comprising a first permanent contact and a first arcing contact that are mounted stationary inside an enclosure, a second permanent contact and a second arcing contact that are mounted to move inside the enclosure along a longitudinal direction and designed to co-operate with the stationary first contacts, and a system for inserting a closure resistance, the moving second contacts forming a portion of equipment carrying a blast nozzle.

OBJECT AND SUMMARY OF THE INVENTION

The object of the invention is to propose a system for inserting the closure resistance in such a circuit breaker, which system is of simple design and makes it possible to obtain a compact assembly with a minimum of moving parts.

To this end, the invention provides such a circuit breaker, wherein said system for inserting the closure resistance comprises a semi-moving block which is disposed to be displaced, during a closure operation, by the blast nozzle along said longitudinal direction and which carries a third arcing contact designed to co-operate with a fixed fourth arcing contact connected to the first permanent contact, displacement of said semi-moving block moving the third and fourth arcing contacts towards each other to short circuit said closure resistance while said first and second arcing contacts are in contact with each other and while the permanent contacts are separate from each other, said permanent contacts being in contact with each other only after the third and fourth arcing contacts have themselves come into contact with each other.

In an advantageous embodiment of the invention, said semi-moving block has a conically-shaped end which engages in the thimble-shaped blast nozzle during the operation of closing the circuit breaker. As a result, the effects of shock between the nozzle and the semi-moving block when they come into contact with each other are eliminated and a displacement speed is obtained for the semi-moving block that is identical to the 5 displacement speed of the first moving contacts on closure of the circuit breaker.

The semi-moving block is tubular in shape and includes a spring which is compressed on closure of the circuit breaker and a chamber which fills with gas during this closure operation so that when the circuit breaker is opened, the spring, on relaxing, automatically displaces the semi-moving block in the displacement direction of the arcing and permanent first contacts to separate the third and fourth arcing contacts. Nevertheless, the displacement of the semi-moving block on circuit breaker opening is delayed and slowed relative to the displacement of the arcing and permanent first contacts since relaxation of the spring is accompanied by the need to evacuate gas from the chamber through calibrated openings.

BRIEF DESCRIPTION OF THE DRAWINGS

An embodiment of the circuit breaker of the invention is described below in greater detail and is shown in the drawings.

MORE DETAILED DESCRIPTION

Figure 1:
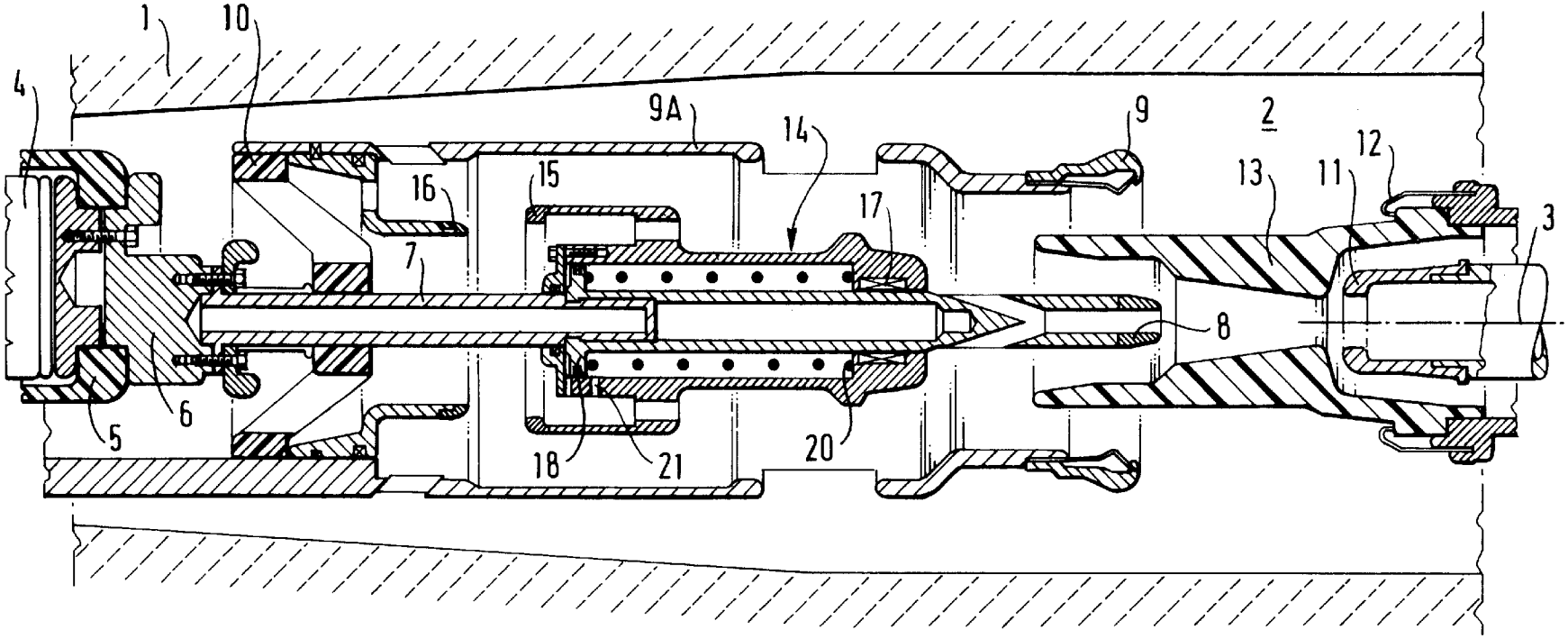
FIG. 1 is a highly diagrammatic section view of a circuit breaker of the invention in the fully open position.

The circuit breaker shown in part in the figures comprises a cylindrically-shaped insulating enclosure 1, e.g. made of porcelain, defining an inside volume 2 that is designed to be filled with a dielectric gas such as $SF_6$ at a pressure of a few bars.

The circuit breaker is a single-action circuit breaker, i.e. having only one piece of moving equipment with arcing and permanent contacts, and it includes a system for inserting a closure resistance organized to make it simple to control the duration for which the resistance is inserted during closure of the circuit breaker, which resistance must not be inserted during opening of the circuit breaker.

The closure resistance 4 is constituted by a stack of resistances housed in an insulating support 5 placed inside the enclosure, at one end thereof. The closure resistance 4 is in electrical contact with a metal block 6 on which there is fixed a metal rod 7 which extends axially inside the enclosure. In the embodiment shown in the figures, the closure resistance 4 extends axially inside the enclosure, however it would also be possible to provide an eccentric position for said resistance within the enclosure, without going beyond the ambit of the invention.

The stationary arcing contact 8 is disposed at the free end of the rod 7. The stationary permanent contact 9 is disposed at one end of a metal tube 9A which is disposed coaxially around the rod 7. An insulating cone 10 is optionally provided to hold the rod 7 inside the tube 9A. These two contacts 8 and 9 co-operate with an arcing contact 11 and a permanent contact 12 that form a portion of moving equipment that moves along the axis 3 and that carries a blast nozzle 13 in the form of a thimble.

The system for inserting the closure resistance 4 comprises a semi-moving metal block 14 of tubular shape which is mounted to be capable of sliding on the rod 7, i.e. along the axis 3. The semi-moving block 14 is electrically connected to the rod 7 by sliding contacts 17. It carries an arcing contact 15 referred to below as the "first switching contact" which is in the form of a thimble that is designed to co-operate with another arcing contact 16 which is in the form of a ring (referred to below as the "second switching contact") disposed inside said cylindrical tube 9A and electrically connected thereto.

It will be observed that the organization of the system for inserting the resistance is disposed essentially axially inside the enclosure which can therefore be of relatively small diameter.

As can be seen in the figures, the semi-moving block 14 has one end facing the blast nozzle 13, which end is in the form of a cone of appropriate size to engage in the nozzle. The other end face of the semi-moving block 14 (left-hand face in the figures) closes behind a compression piston 18 which is constituted by a ring secured to the rod 7.

A spring 20 is mounted between the piston 18 and a shoulder behind the conical end of the semi-moving block. The space defined between said piston and said other end face constitutes a chamber 19 of variable volume. The chamber 19 in the semi-moving block is in communication with the inside volume of the tube 9A via openings 21.

The system for inserting the closure resistance of the circuit breaker operates as follows.

In FIG. 1 the circuit breaker is in its fully open position. The stationary contacts 8 and 9 are separated from the moving contacts 11 and 12. The contact 15 is separated from the contact 16. The spring 20 in the semi-moving block is completely relaxed and the space between the piston 18 and the left-hand end face of the semi-moving block is at a minimum.

As can be seen in this figure, the arcing contacts 8 and 11 are, by construction, not as far apart from each other as are the permanent contacts 9 and 12, which means that on closure of the circuit breaker the contacts 8 and 11 will make mutual contact before the contacts 9 and 12. In addition, the switching contacts 15 and 16 are spaced apart from each other by a distance such that these contacts make mutual contact after the arcing contacts have made contact but before the permanent contacts make contact, thereby making it possible by means of the displacement of the semi-moving block to control the duration for which the resistance 14 is inserted during closure, as explained below.

Figure 2:
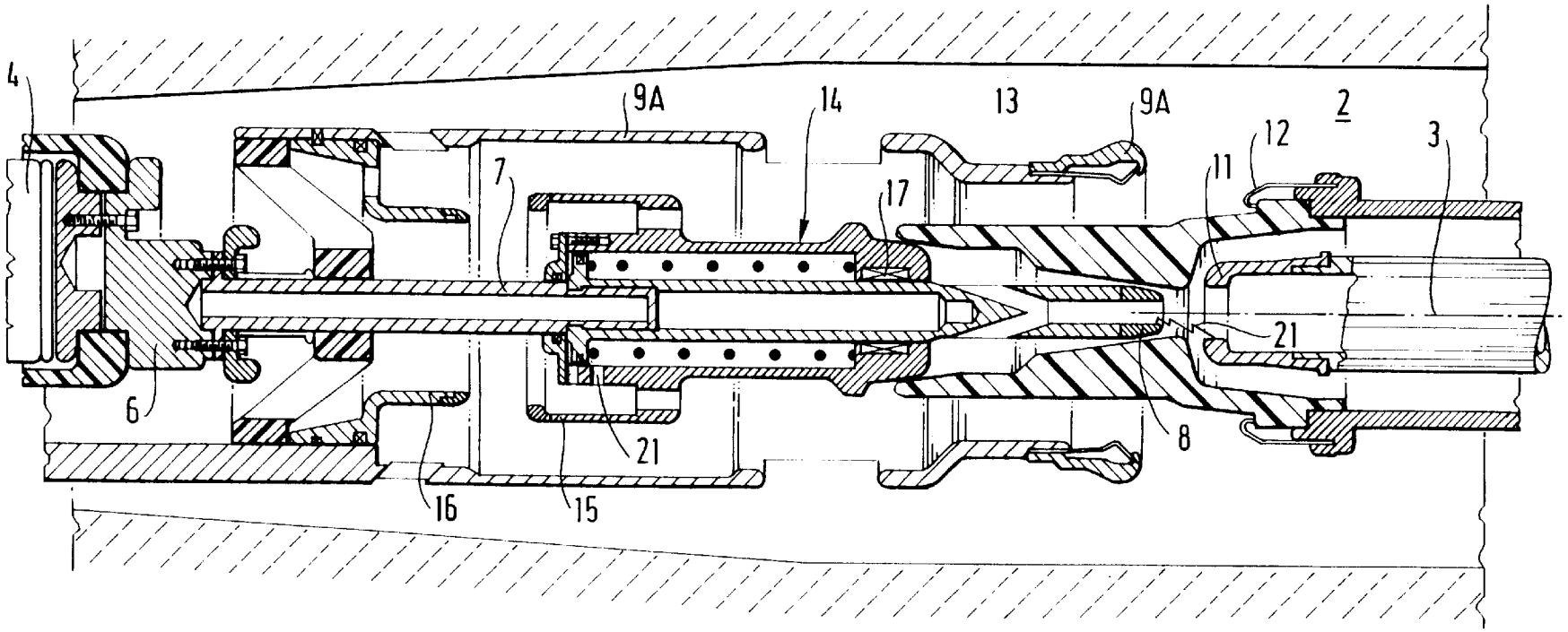
FIG. 2 is a highly diagrammatic view of the FIG. 1 circuit breaker in a first intermediate closure position.

In FIG. 2, during an operation to close the circuit breaker, the moving arcing and permanent contacts 11 and 12 have moved closer to the stationary arcing and permanent contacts 8 and 9. Initially, an electric arc 21 is struck between the arcing contacts 11 and 8. The current flows from a current terminal of the circuit breaker (not shown, but to the right of the figure) to the arcing contact 11, and then to the arcing contact 8, the rod 7, the metal block 6, the closure resistance 4, the end of the tube 9A that is not shown, and finally the other current terminal that is also not shown (to the left of the figure). The closure resistance is thus inserted.

Figure 3:
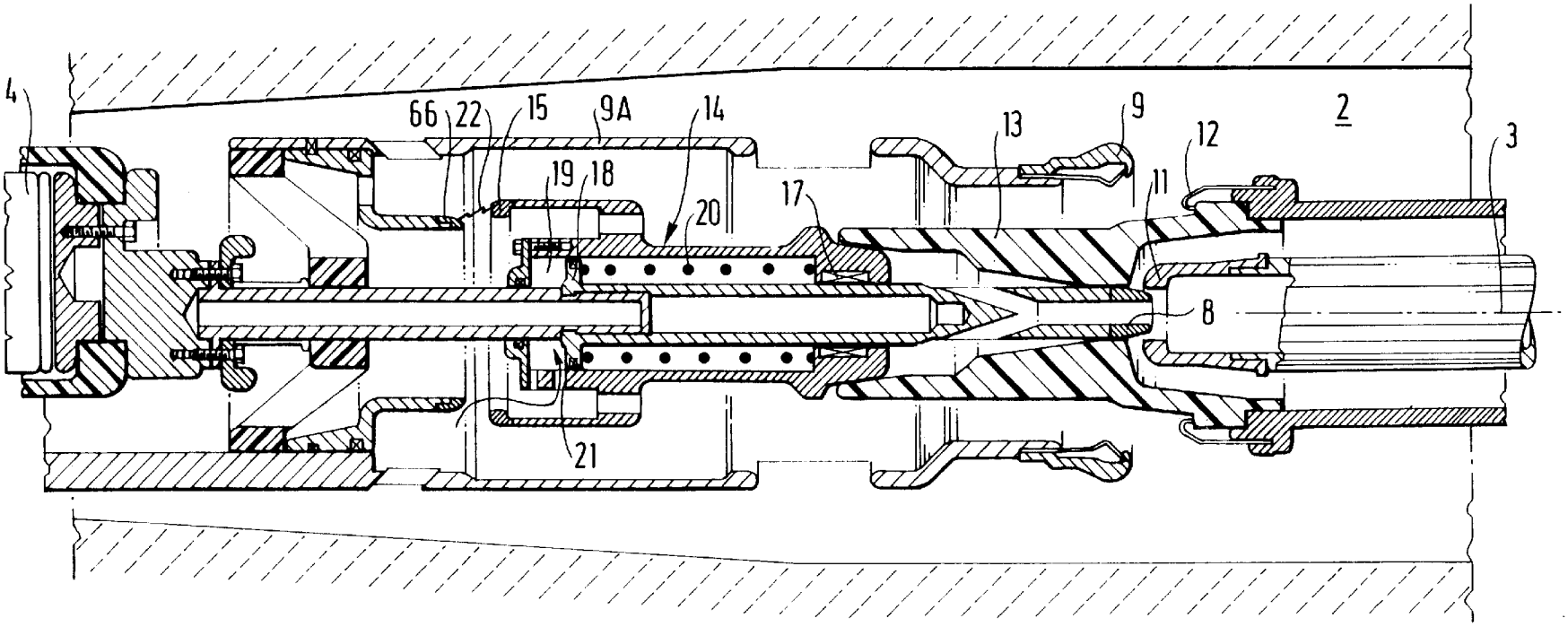
FIG. 3 is a highly diagrammatic view of the FIG. 1 circuit breaker in a second intermediate closure position.

In FIG. 3, the moving arcing and permanent contacts 11 and 12 continue to move towards the stationary arcing and permanent contacts 8 and 9. The end of the nozzle 13 secured to the moving equipment then engages on the conical end of the semi-moving block and pushes it along the axis 3, thus causing the switching contacts 15 and 16 to move towards each other. It will be observed that by means of this engagement, the nozzle 13 is prevented from impacting against the semi-moving block such that the switching contacts move towards each other at the same speed as the arcing contacts 8 and 11 or the permanent contacts 9 and 12. Simultaneously, the displacement of the semi-moving block relative to the fixed piston 18 causes the volume of the chamber 19 to increase and deforms the spring 20 (in this case compresses the spring). The chamber 19 fills with gas which passes through the openings 21. At a certain moment, as shown in FIG. 3, the arcing contacts 8 and 11 are in mutual contact while the switching contacts 15 and 16 are just close enough together to enable an electric arc 22 to be struck between them while it is still not possible for an electric arc to be struck between the permanent contacts 9 and 12. At this particular instant the permanent contacts are further apart from each other than are the switching contacts. At this instant, the closure resistance 4 is short circuited since the current flows between the arcing contacts 11 and 8, along the rod 7, into the sliding contacts 17, the semi-moving block 14, the switching contact 15, the other switching contact 16, and thus the tube 9A. It will therefore be understood that the length of time that the resistance 4 is inserted is restricted to the duration between the instant at which the arc 21 is struck between the arcing contacts and the instant at which the arc 22 is struck between the switching contacts. It can also be seen that after the resistance has been inserted, current is not switched directly to the permanent contacts.

Figure 4:
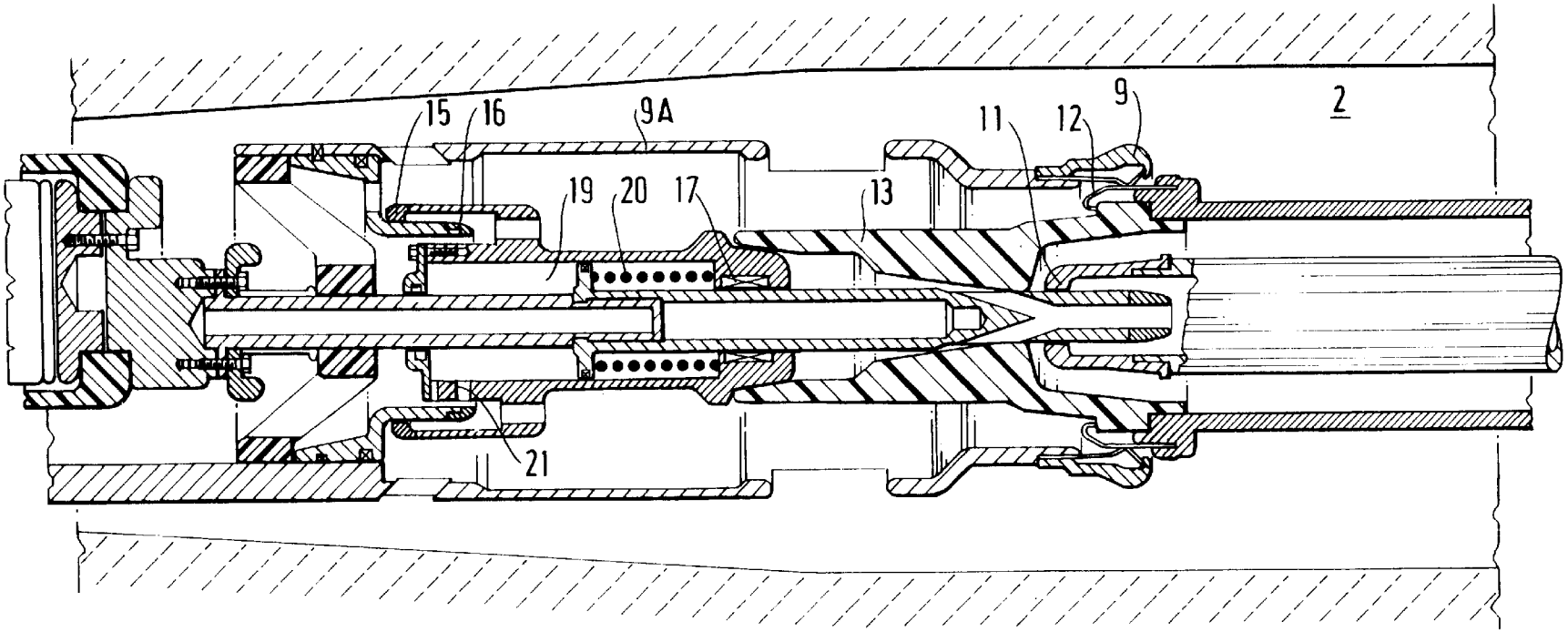
FIG. 4 is a highly diagrammatic view of the FIG. 1 circuit breaker in a fully closed position.

In FIG. 4, the nozzle 13 continues to push the semi-moving block 14, and before reaching the end of stroke for the moving contacts 11 and 12, mutual contact is obtained between the switching contacts 15 and 16 prior to mutual contact being obtained between the permanent contacts 9 and 12. Thereafter current flows via the permanent contacts so that the circuit breaker is in a fully closed position. The volume of the compression chamber 19 is now at its maximum and the spring 20 is fully compressed.

Figure 5:
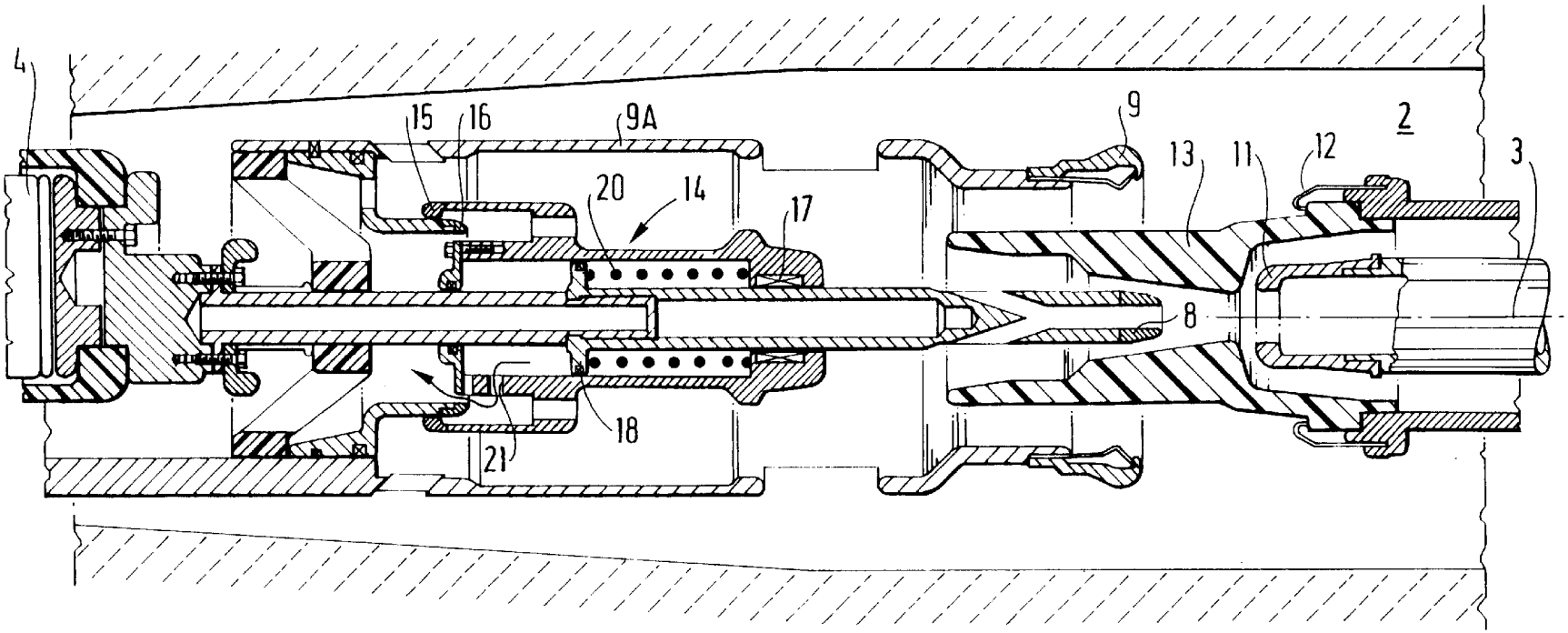
FIG. 5 is a highly diagrammatic view of the FIG. 1 circuit breaker in an intermediate opening position.
Figure 6:
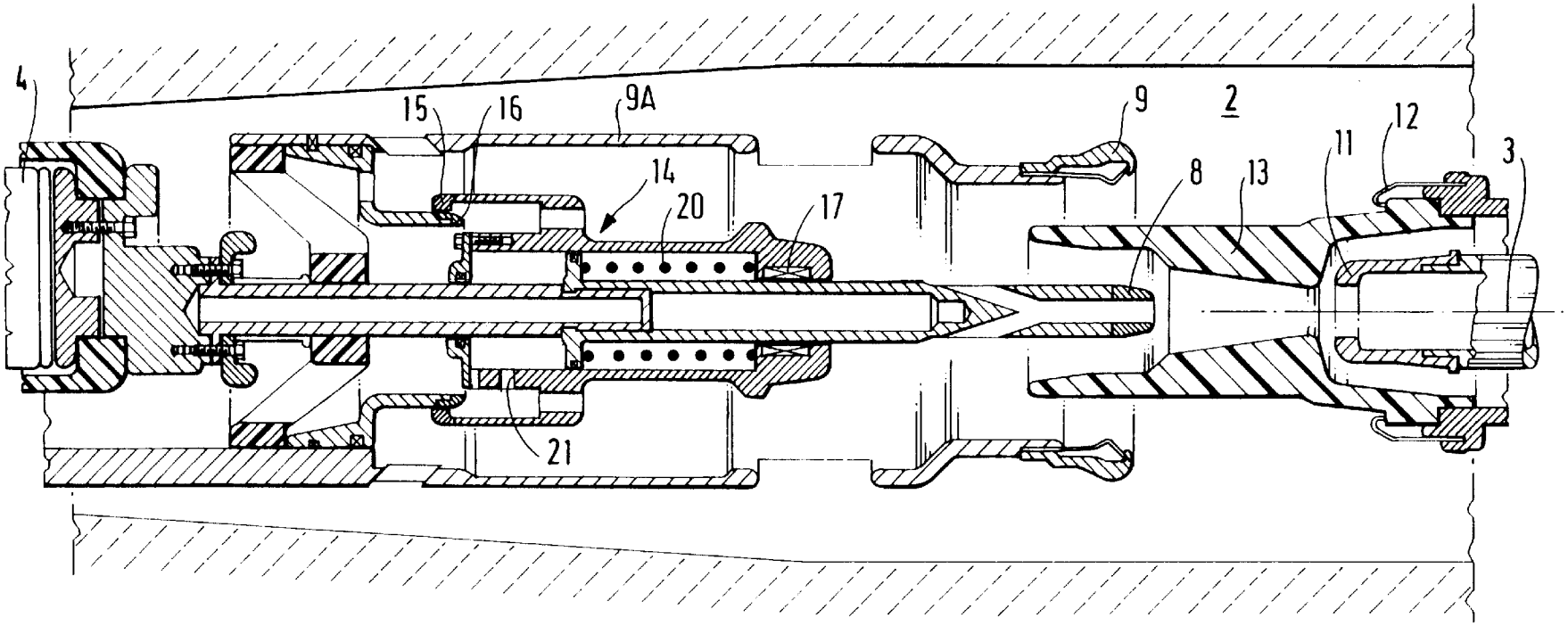
FIG. 6 is a highly diagrammatic view of the FIG. 1 circuit breaker in a second intermediate opening position.

During an opening operation, the moving contacts 11 and 12 move from the left towards the right in the figures. The permanent contacts 9 and 12 are the first to separate from one another, after which the arcing contacts 8 and 11 separate while the switching contacts 15 and 16 remain in contact with each other for a certain length of time as can be seen in FIGS. 5 and 6 since the semi-moving block moves more slowly than the moving contacts. The semi-moving block moves from left to right on the figures under drive from the spring 20 which exerts a return force as it expands against the piston 18. Nevertheless, the expansion of the spring 20 is retarded and slowed down by the fact that an opposing force counters the return force exerted by the spring. The opposing force is the result of the need to compress the gas in the chamber 19, whose volume decreases as the semi-moving block moves, given that the gas exhaust openings from said chamber are calibrated in appropriate manner. This calibration is such that the switching contacts 15 and 16 separate from each other only after the arcing contacts have separated fully. As a result, the short circuit current cannot flow through the closure resistance 4 while the circuit breaker is opening. It is only when the electric arc which is struck between the arcing contacts has been extinguished, in particular by blast, that the semi-moving block 14 finishes its stroke and separates the switching contacts 15 and 16 so as to return to the initial position as shown in FIG. 1.

I claim:

1. A circuit breaker comprising:

an enclosure having a longitudinal axis defining a longitudinal direction;

a first stationary permanent contact and a first stationary arcing contact mounted inside said enclosure so as to be stationary with respect to said enclosure;

a second permanent contact and a second arcing contact movably mounted inside the enclosure so as to be movable in the longitudinal direction, said second permanent contact and said second arcing contact are mounted within said enclosure so as to respectively co-operate with the first stationary permanent contact and the first stationary arcing contact, the second permanent contact and the second arcing contact forming a portion of equipment carrying a blast nozzle;

a closure resistance electrically connected to said first stationary arcing contact; and a system for inserting the closure resistance including a semi-moving block which is disposed to be displaced, during a closure operation, by the blast nozzle along said longitudinal direction and which carries a first switching contact designed to co-operate with a fixed second switching contact which is fixedly connected to the first stationary permanent contact, wherein displacement of said semi-moving block in a closing direction moves the first and second switching contacts towards each other to short circuit said closure resistance while said first and second arcing contacts are in contact with each other and while the permanent contacts are separate from each other, said permanent contacts being in contact with each other only after the first and second switching contacts have themselves come into contact with each other.

2. A circuit breaker according to claim 1, wherein said blast nozzle is thimble-shaped, and in which said semi-moving block has a conically-shaped end which engages in the thimble-shaped blast nozzle during the operation of closing the circuit breaker.

3. A circuit breaker according to claim 1, in which the semi-moving block is tubular in shape and includes a spring which is deformed on closure of the circuit breaker, and a chamber which fills with gas during said closure operation such that during opening of the circuit breaker, said spring exerts a return force biasing the semi-moving block in the longitudinal direction toward the second permanent moving contact, with displacement of the semi-moving block being retarded and slowed down relative to that of the second permanent moving contact and second arcing contact due to compression of the gas inside the chamber.

4. A circuit breaker according to claim 3, in which the chamber has calibrated openings so that, during opening of the circuit breaker, a force resists the return force of the spring.

5. A circuit breaker according to claim 1, in which said closure resistance, said semi-moving block, said first stationary permanent contact, said first stationary arcing contact, said second permanent contact, said second arcing contact, said first switching contact, and said second switching contact are disposed in axial alignment inside the enclosure.

* * * * *